US005448506A

United States Patent [19]

Tateno

[11] Patent Number: 5,448,506

[45] Date of Patent: Sep. 5, 1995

[54] MULTIPLICATION OPERATIONAL CIRCUIT DEVICE

[75] Inventor: Tetsuya Tateno, Isehara, Japan

[73] Assignee: Canon Kabushiki Kaisha, Tokyo, Japan

[21] Appl. No.: 221,449

[22] Filed: Apr. 1, 1994

Related U.S. Application Data

[63] Continuation of Ser. No. 807,238, Dec. 16, 1991, abandoned.

[30] Foreign Application Priority Data

Jan. 8, 1991 [JP] Japan ..... 3-000557

[51] Int. Cl.[6] ..... G06J 1/00

[52] U.S. Cl. ..... 364/606; 364/602

[58] Field of Search ..... 364/602, 606; 341/133, 341/135, 144; 307/573, 355

[56] References Cited

U.S. PATENT DOCUMENTS

| | | | |
|---|---|---|---|
| 3,504,360 | 3/1970 | Vosbury et al. . | |
| 3,683,165 | 8/1972 | Grobert | 364/606 |
| 3,699,568 | 10/1972 | Thompson et al. | 341/154 |
| 3,810,157 | 5/1974 | Kallio | 341/154 |
| 3,857,021 | 12/1974 | Wilensky et al. | 364/606 |
| 4,422,155 | 12/1983 | Amir et al. | 364/606 |
| 4,470,126 | 9/1984 | Hague | 364/606 |
| 4,475,170 | 10/1984 | Hague | 364/606 |
| 4,631,522 | 12/1986 | Cabot | 341/154 |
| 4,751,497 | 6/1988 | Torii | 341/154 |
| 4,982,192 | 1/1991 | Murooka | 341/135 |
| 5,311,454 | 5/1994 | Canales | 364/606 |

FOREIGN PATENT DOCUMENTS

| | | |
|---|---|---|
| 0310524 | 4/1989 | European Pat. Off. . |
| 3529338 | 6/1986 | Germany . |

OTHER PUBLICATIONS

R. H. Breedlove, "Ladder Decoder", IBM Technical Disclosure Bulletin, vol. 3, No. 7, Dec. 1960, p. 17.

M. E. Van Valkenburg, "Network Analysis", Third Edition, 1974 by Prentice-Hall, Inc., pp. 36–37 and 81–82.

*Primary Examiner*—Tan V. Mai

*Attorney, Agent, or Firm*—Fitzpatrick, Cella, Harper & Scinto

[57] ABSTRACT

An operational circuit device for calculating a plurality of bit data includes, an input unit for inputting a plurality of bit data, a constant current source provided for each of the plurality of bit data for generating a predetermined current in accordance with the bit data inputted from the input unit and a calculation unit for calculating a sum of the predetermined currents from the constant current sources.

5 Claims, 5 Drawing Sheets

| *A0 | *A1 | *A2 | *A3 | *B0 | *B1 | *B2 | *B3 | OUTPUT VOLTAGE [V] |
|---|---|---|---|---|---|---|---|---|
| 1 | 0 | 0 | 0 | 0 | 0 | 0 | 0 | $REF - \frac{1}{8} RI$ |
| 0 | 0 | 0 | 0 | 1 | 0 | 0 | 0 | $REF - \frac{1}{8} RI$ |
| 0 | 1 | 0 | 0 | 0 | 0 | 0 | 0 | $REF - \frac{1}{4} RI$ |
| 0 | 0 | 0 | 0 | 0 | 1 | 0 | 0 | $REF - \frac{1}{4} RI$ |
| 0 | 0 | 1 | 0 | 0 | 0 | 0 | 0 | $REF - \frac{1}{2} RI$ |
| 0 | 0 | 0 | 0 | 0 | 0 | 1 | 0 | $REF - \frac{1}{2} RI$ |
| 0 | 0 | 0 | 1 | 0 | 0 | 0 | 0 | REF - RI |
| 0 | 0 | 0 | 0 | 0 | 0 | 0 | 1 | REF - RI |

FIG. 2

| *A0 | *A1 | *A2 | *A3 | *B0 | *B1 | *B2 | *B3 | OUTPUT VOLTAGE [V] |
|---|---|---|---|---|---|---|---|---|
| 1 | 0 | 0 | 0 | 0 | 0 | 0 | 0 | REF − $\frac{1}{8}$ RI |
| 0 | 0 | 0 | 0 | 1 | 0 | 0 | 0 | REF − $\frac{1}{8}$ RI |
| 0 | 1 | 0 | 0 | 0 | 0 | 0 | 0 | REF − $\frac{1}{4}$ RI |
| 0 | 0 | 0 | 0 | 0 | 1 | 0 | 0 | REF − $\frac{1}{4}$ RI |
| 0 | 0 | 1 | 0 | 0 | 0 | 0 | 0 | REF − $\frac{1}{2}$ RI |
| 0 | 0 | 0 | 0 | 0 | 0 | 1 | 0 | REF − $\frac{1}{2}$ RI |
| 0 | 0 | 0 | 1 | 0 | 0 | 0 | 0 | REF − RI |
| 0 | 0 | 0 | 0 | 0 | 0 | 0 | 1 | REF − RI |

MULTIPLICATION OPERATIONAL CIRCUIT DEVICE

This application is a continuation of application Ser. No. 07/807,238 filed Dec. 16, 1991.

BACKGROUND OF THE INVENTION

1. Field of the Invention

The present invention relates to an operational circuit device for calculation, such as addition, multiplication and the like.

2. Related Background Art

In calculating a plurality of digital signals and outputting the results as an analog signal, conventionally, as shown in FIG. 5, a plurality of inputted digital signals are calculated by a digital operational circuit 71, and the calculated results are inputted to an analog converter 72 to obtain an analog signal.

With the above-described conventional circuit arrangement, a digital operational circuit having a large area is used, resulting in a large operational circuit device.

SUMMARY OF THE INVENTION

It is an object of the present invention to provide an improved operational circuit device.

It is another object of the present invention to provide a compact and high speed operational circuit device.

It is a further object of the present invention to provide an operational circuit device which does not use a digital operational circuit.

The other objects and advantages of the present invention will become apparent from the following detailed description when read in connection with the accompanying drawings.

BRIEF DESCRIPTION OF THE DRAWINGS

FIG. 2 is a table showing the relationship between input data and output voltage of the addition operational circuit device shown in FIG. 1.

DESCRIPTION OF THE PREFERRED EMBODIMENTS

Figure 1:
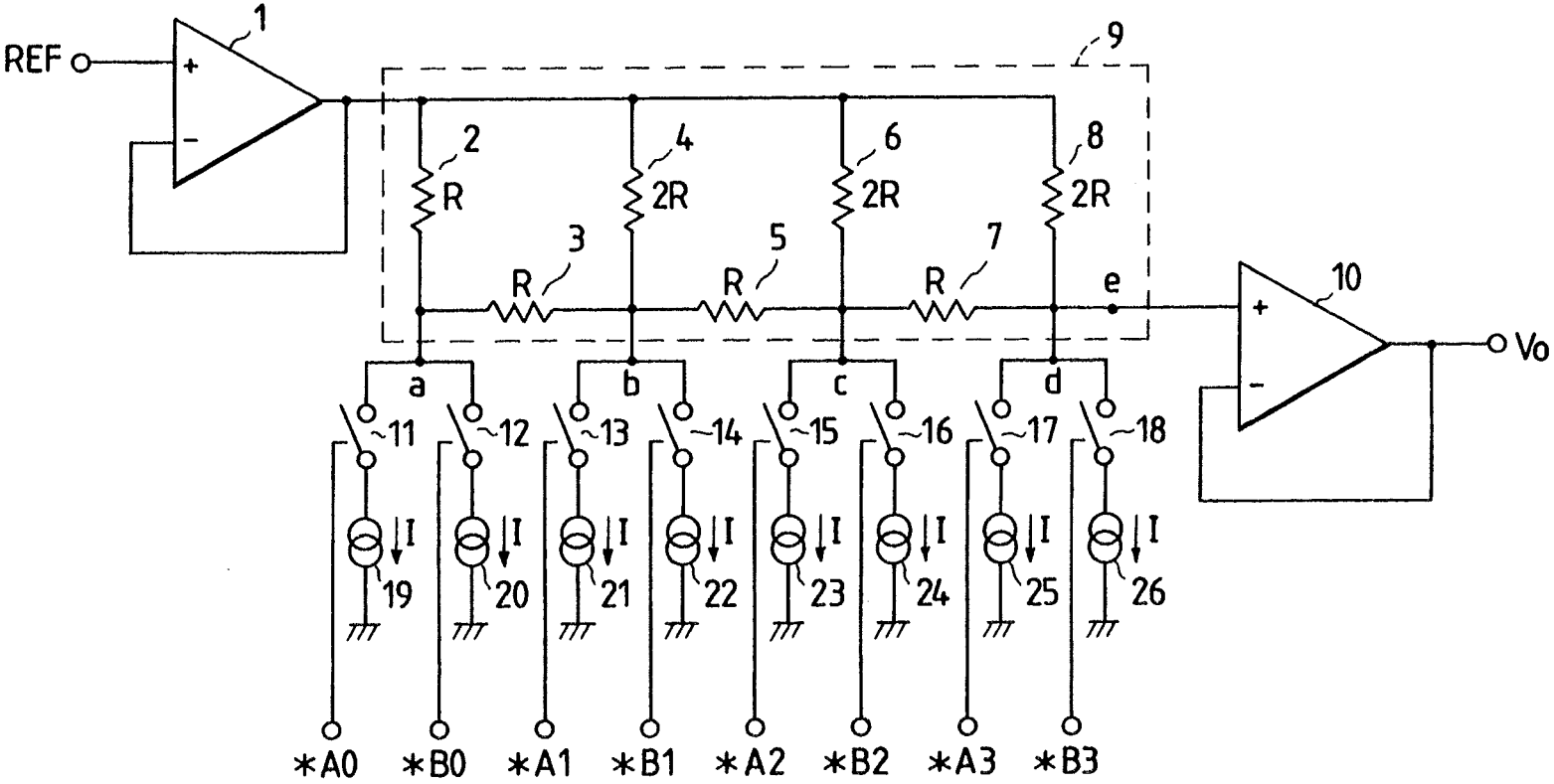
FIG. 1 is a circuit diagram of an addition operational circuit device according to an embodiment of the present invention.

FIG. 1 is a circuit diagram of an addition operational circuit device according to a first embodiment of the present invention. Reference numeral 1 represents an operational amplifier for outputting an analog reference voltage, reference numerals 2 to 8 represent resistors connected in a ladder form constituting a resistor ladder unit 9. The values of the resistors 2, 3, 5, and 7 are R (ohm), and the values of the resistors 4, 6, and 8 are 2R (ohm). At an interconnection point e, a voltage appears whose amplitude corresponds to the current states at interconnection points a, b, c, and d. Reference numeral 10 represents an operational amplifier for buffering an output voltage of the resistor ladder unit 9. Reference numerals 11 to 18 represent switches which are switched in accordance with inputted digital signals. If an input digital signal is "0", the switch is disconnected, and if "1", it is connected. The switches 11 and 12 are connected to the interconnection point a between the resistors 2 and 3, the switches 13 and 14 are connected to the interconnection point b between the resistors 3, 4, and 5, the switches 15 and 16 are connected to the interconnection point c between the resistors 5, 6, and 7, and the switches 17 and 18 are connected to the interconnection point d between the resistors 7 and 8. Reference numerals 19 to 26 represent constant current sources connected in series to corresponding switches 11 to 18. *A0 to *A3 and *B0 to *B3 are the inverted bits of input data A0 to A3 and B0 to B3. *A0 to *A3 are connected to the switches 11, 13, 15, and 17, and *B0 to *B3 are connected to the switches 12, 14, 16, and 18. Two input data A and B to be added together are inverted by inverters (not shown). The switch corresponding to the inverted bit *A0 to *A3 and *B0 to *B3 having a value "1" is connected to thereby cause a predetermined current to flow from the corresponding constant current source. Such constant currents are summed up for each digit (0-th, 1st, 2nd, and 3rd) at the interconnection points a, b, c, and d and flow into the resistor ladder unit 9. At the interconnection point e of the resistor ladder unit 9, there appears a voltage $V_0$ proportional to the sum of weighted currents at the interconnection points. FIG. 2 shows output voltages $V_0$ when one of the bits *A0 to *A3 and *B0 to *B3 takes "1", and all the remaining bits take "0". An output voltage $V_0$ when two or more bits take "1" can be obtained using the principle of superposition. For example, if the bits *A0 and *B0 are "1", the output voltage $V_0$ becomes REF−RI/8−RI/8=REF−RI/4 (volt). This voltage is equal to the voltage obtained when the bit *A1 or *B1 higher by one digit takes "1". If all the bits *A0 to *A3 and *B0 to *B3 are "1", the output voltage $V_0$ becomes REF−3-0RI/8 (volt). The addition results between the data A and B are obtained as an output voltage $V_0$ in the manner described above.

As described above, addition can be carried out by adding currents for respective digits without using a digital adder, thereby reducing the circuit dimension.

Figure 3:
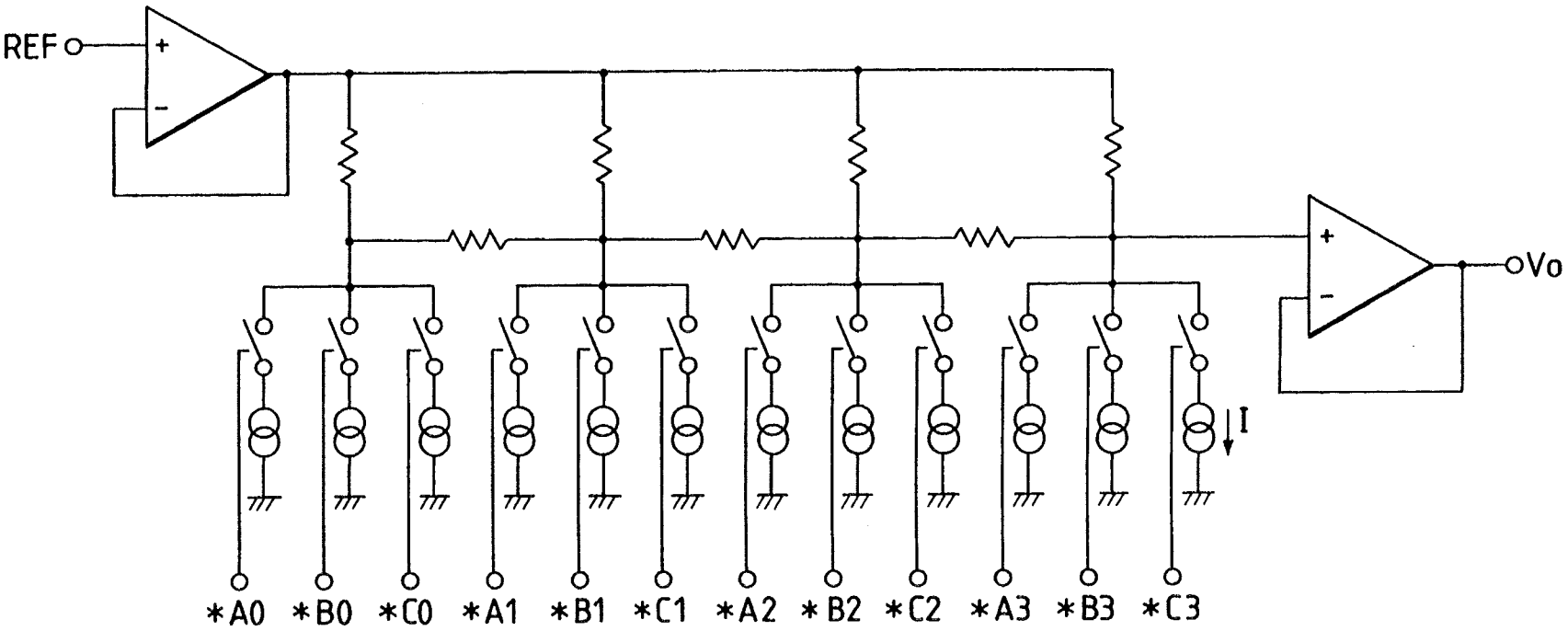
FIG. 3 is a circuit diagram of an addition operational circuit device according to another embodiment of the present invention.

If three or more data are to be added together, current sources for respective digits and corresponding switches are connected in parallel as shown in FIG. 3.

Another embodiment will be described below.

Figure 4:
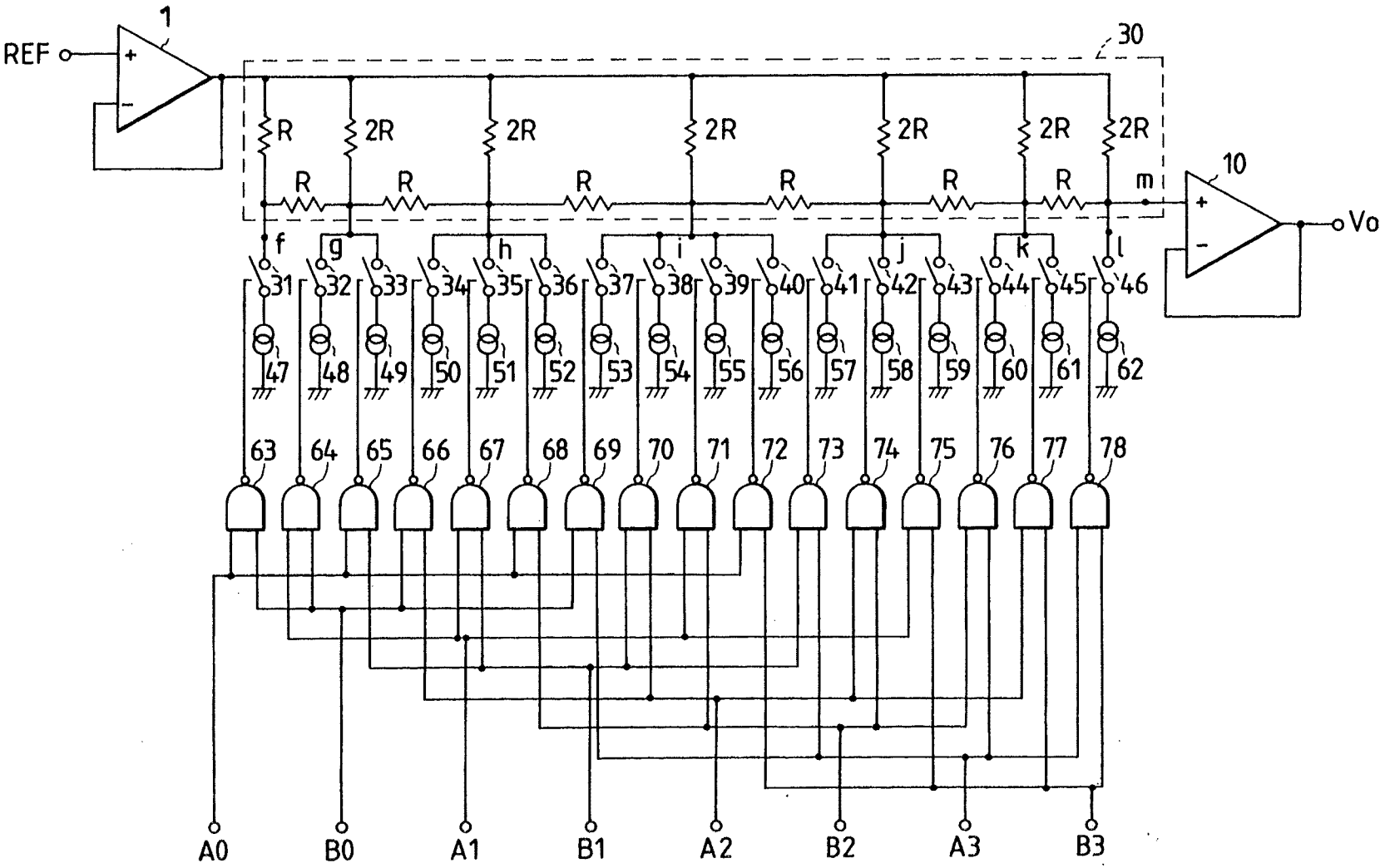
FIG. 4 is a circuit diagram of a multiplication operational circuit device according to another embodiment of the present invention.
Figure 5:
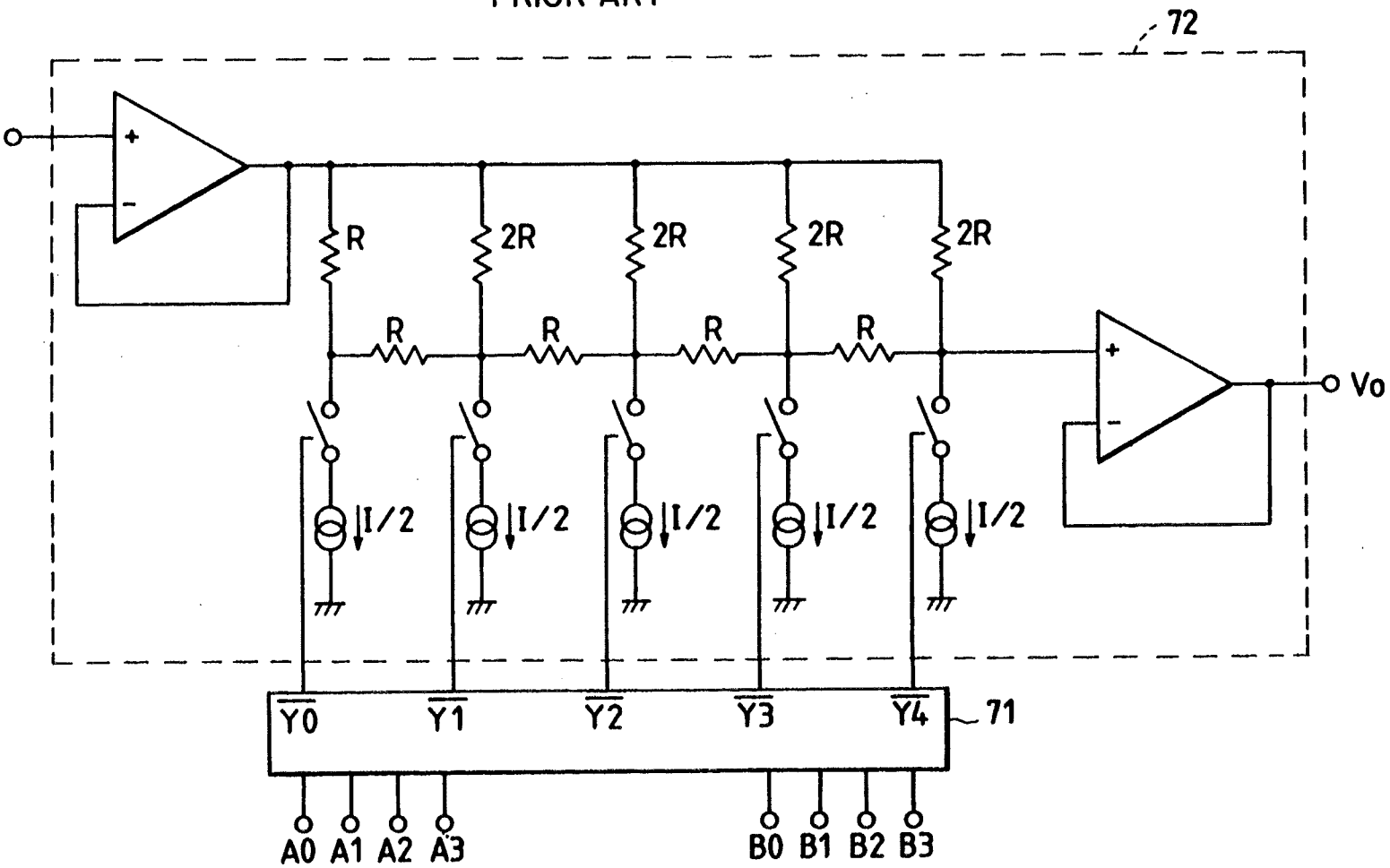
FIG. 5 PRIOR ART
FIG. 5 is a circuit diagram of a conventional addition operational circuit device.

FIG. 4 is a circuit diagram of a multiplication operational circuit device according to a second embodiment of the present invention. Reference numeral 1 represents an operational amplifier for outputting an analog reference voltage, reference numeral 30 represents a resistor ladder unit for generating a voltage corresponding to the current states at interconnection points, similar to the first embodiment. Reference numeral 10 represents an operational amplifier for buffering an output voltage of the resistor ladder unit 30. Reference numerals 31 to 46 represent switches. Reference numerals 47 to 62 represent constant current sources connected in series to the corresponding switches 31 to 46. A0 to A3 and B0 to B3 are values at respective digits of input data A and B to be multiplied together. Reference numerals 63 to 78 represent NAND gates for performing a NAND operation for each term. The switches 31 to 46 are connected when an output of the corresponding NAND gates 63 to 78 takes "1". The NAND gates 63 to 78 carry out a multiplication operation for each term (A0 to A3, B0 to B3) of the input data A and B. The constant current sources 47 to 62, switches 31 to 46, interconnection points f to l carry out an addition of the multiplied results at the same term. The resistor ladder unit 30 carries out an addition operation for each digit including a carry.

Upon input of two data A and B to be multiplied together, the switch corresponding to the bit *(A0×B0) to *(A3×B3) having a value "1" is connected to thereby cause a predetermined current to flow from the corresponding constant current source. Such constant currents are summed up for each term at the interconnection points f to l and flow into the resistor ladder unit 30. At the interconnection point m of the resistor ladder unit 30, there appears a voltage $V_0$ proportional to the sum of weighted currents at the interconnection points. Namely, the product for each term is carried out by the NAND gate, and the results are added together by the resistor ladder circuit to output the multiplication results.

As described above, a digital multiplication circuit can be realized by one stage of NAND gates, resulting in a circuit of small dimension and performing high speed calculation.

As appreciated from the foregoing description, without using a digital operational circuit, addition of currents from constant current sources are used, so that it possible to provide an operational circuit device of small dimension and of high speed.

What is claimed is:

1. A multiplying apparatus comprising:

a plurality of input means for inputting a plurality of data, each data having a plurality of bits;

a plurality of logical sum means, each for logically summing one bit of a respective one of the data with all bits of all others of the data so as to generate a respective logical sum bit, wherein each logical sum bit has a rank and pluralities of said logical sum bits have a same rank;

a plurality of current sources respectively provided for said plurality of logical sum means for generating a respective predetermined current in accordance with the logical sum bit generated by the respective one of said plurality of logical sum means;

a plurality of first adding means respectively corresponding to the ranks of said logical sum bits from said logical sum means, each of said first adding means adding the predetermined currents from each current source respectively provided for the plural logical sum means generating logical sum bits of the same rank and outputting a respective added current; and second adding means for weighting and adding the added currents from all of said plurality of first adding means, thereby generating a generated current proportional to a product of said plurality of data.

2. A multiplying apparatus according to claim 1, wherein said second adding means converts said generated current into a voltage and outputs said voltage.

3. A multiplying apparatus according to claim 1, wherein each of said plurality of current sources generates the respective predetermined current when the respective logical sum bit is 1, and does not generate the respective predetermined current when the respective logical sum bit is 0.

4. A multiplying apparatus according to claim 1, wherein each of said plurality of logical sum means is a NAND gate.

5. A multiplying apparatus according to claim 1, wherein said second adding means includes a resistor ladder.

* * * * *